United States Patent [19]

McCarty

[11] Patent Number: 4,674,593

[45] Date of Patent: Jun. 23, 1987

[54] SOUND BARRIER FENCE

[76] Inventor: Danny W. McCarty, 6990 Dawn Cir., Broken Arrow, Okla. 74014

[21] Appl. No.: 718,935

[22] Filed: Apr. 2, 1985

[51] Int. Cl.[4] ..... E04H 17/00; G10K 11/00

[52] U.S. Cl. ..... 181/210; 181/290; 181/294

[58] Field of Search ..... 181/210, 290, 284, 285, 181/294

[56] References Cited

U.S. PATENT DOCUMENTS

| | | | |
|---|---|---|---|
| 906,025 | 12/1908 | Howe . | |
| 979,310 | 12/1910 | Kammerer . | |
| 1,654,030 | 12/1927 | Ashenhurst . | |
| 2,021,359 | 11/1935 | Halstead . | |
| 2,175,630 | 10/1939 | Kiesel . | |
| 2,423,199 | 7/1947 | Milnor . | |
| 2,718,138 | 9/1955 | Jones . | |
| 2,882,990 | 4/1959 | Mustoe . | |
| 3,630,310 | 12/1971 | Federer . | |
| 3,656,576 | 4/1972 | Gubela . | |
| 3,667,175 | 6/1972 | Bjorksten . | |
| 3,828,504 | 8/1974 | Egerborg et al. | 181/285 X |
| 3,956,563 | 5/1976 | Spang et al. | 181/290 X |
| 3,983,956 | 10/1976 | Manhart . | |
| 4,042,061 | 8/1977 | Murakami | 181/210 |
| 4,325,457 | 4/1982 | Docherty et al. | 181/210 |

*Primary Examiner*—Benjamin R. Fuller

*Attorney, Agent, or Firm*—Head Johnson Stevenson

[57] ABSTRACT

This is a sound barrier fence adapted to reduce the noise level in a yard which is adjacent a freeway for example. The fence includes two spaced apart upright panels of a dense material such as concrete. The space between the panels which may be three to four inches in width, for example, is filled with a foam insulation material. Posts are provided to hold the upright members in place and rail caps and post caps are provided to keep water out of the interior of the fence.

4 Claims, 7 Drawing Figures

SOUND BARRIER FENCE

BACKGROUND OF THE INVENTION

1. Field of the Invention

This invention relates to a sound barrier for use between a noise producing area such as a freeway and a protected area such as residential homes.

2. Prior Art

It is well recognized that noise in some cases has become a major problem in this country. This is particularly true along freeways that go through residential areas. Various means have been devised to attempt to reduce the noise level in such protected areas as the residential areas. Such means includes erecting masonry walls of stone or brick or concrete six to ten feet in height and also the planting of shrubbery such as small trees between the noise making area and the protected area. Although this has been of some help, it does not give the protection or the noise reduction that is desired. For example, it is believed that these prior art methods reduce the noise level not over about 40% at best.

SUMMARY OF THE INVENTION

This invention relates to a sound barrier fence. In a preferred embodiment, it includes two concrete panels spaced apart a selected distance, e.g., three to four inches. The panels, for example, may be anywhere from five feet to fifteen feet or more in height. The space between the panels is filled with a foam insulation material.

The panels are manufactured preferably in sections about five feet long and are held in the upright position by special concrete posts set in a concrete footing. These concrete posts have grooves for receiving the panel. A rail cap is placed over the top of the fence between the posts and a post cap is placed across the top of the posts. The post cap and rail cap prevents water from running into the interior of the barrier fence.

It is an object of this invention to provide a sound barrier fence to protect residential areas from noises such as that from freeways. The sound barrier fence can also be used anywhere it is desired to protect one area from the sound produced in another adjacent area.

Various other objects and a better understanding of the invention can be had from the following description taken in conjunction with the drawings.

DETAILED DESCRIPTION OF THE PREFERRED EMBODIMENT

Figure 2:
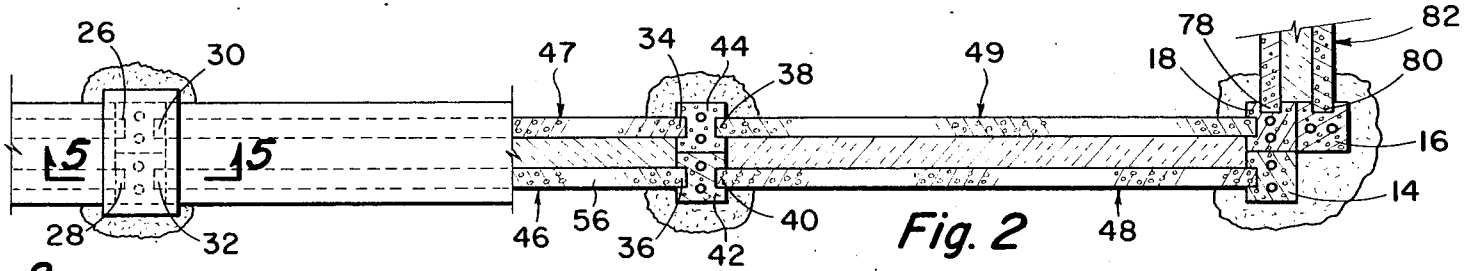
FIG. 2 is a sectional view taken along the line 2—2 of FIG. 1.
Figure 1:
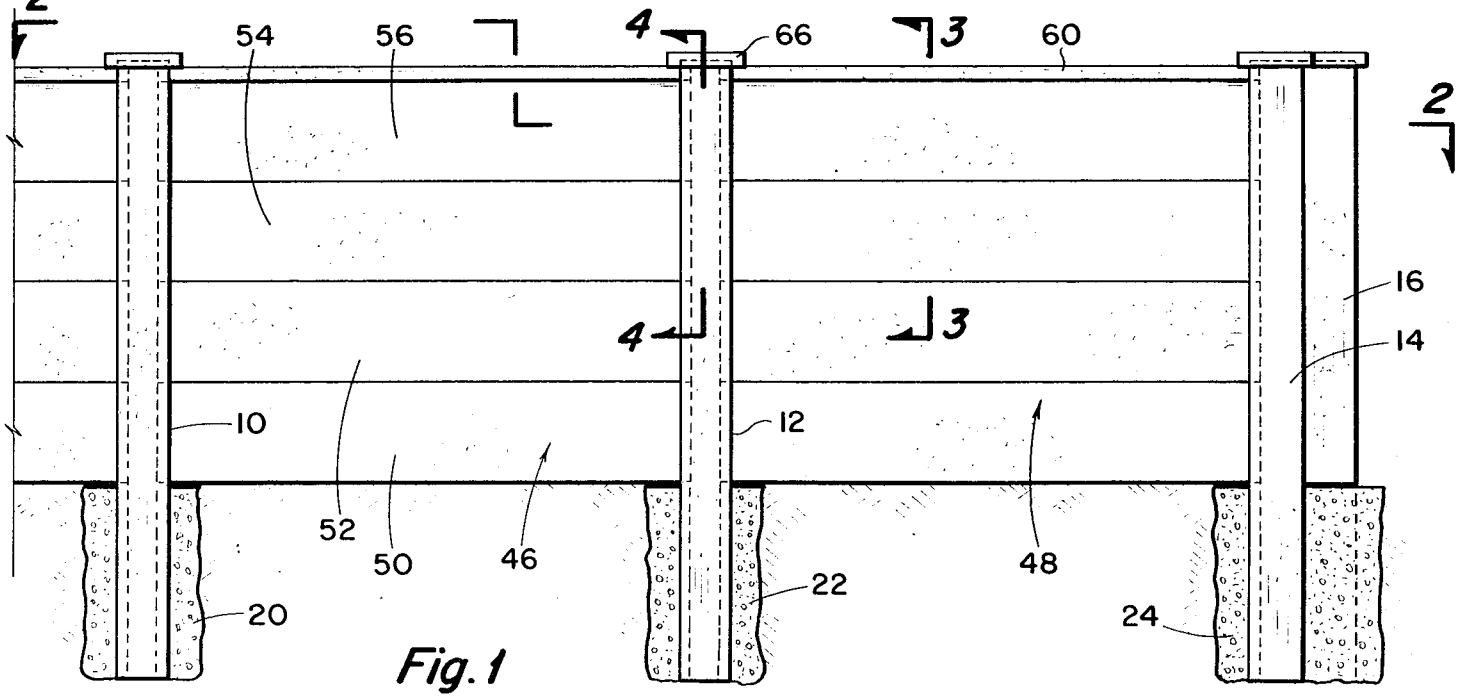
FIG. 1 is a side elevational view of the sound barrier fence of my invention.

Attention is now directed to the drawings and especially to FIG. 1 which shows upright concrete post 10, 12 and 14. The posts are set in the concrete footings 20, 22 and 24. Post 10, as shown in FIG. 2, has two vertical grooves 26 and 28 on one side and grooves 30 and 32 on the other side. Concrete post 12 has similar vertical grooves 34 and 36 on one side and 38 and 40 on the other side. Post 12 can be either one member or, as indicated in FIG. 2, it can be two identical members 42 and 44 which abutt each other. The other posts 10 and 14 can likewise be the same way. Post 14 has vertical grooves. A concrete rail panel 46 is provided between posts 10 and 12 and a panel 48 is provided between posts 12 and 14. Each panel 46 may comprise a plurality of panel sections 50, 52, 54 and 56. Post 14 has vertical grooves for receiving panels 48 and 49.

Figure 3:
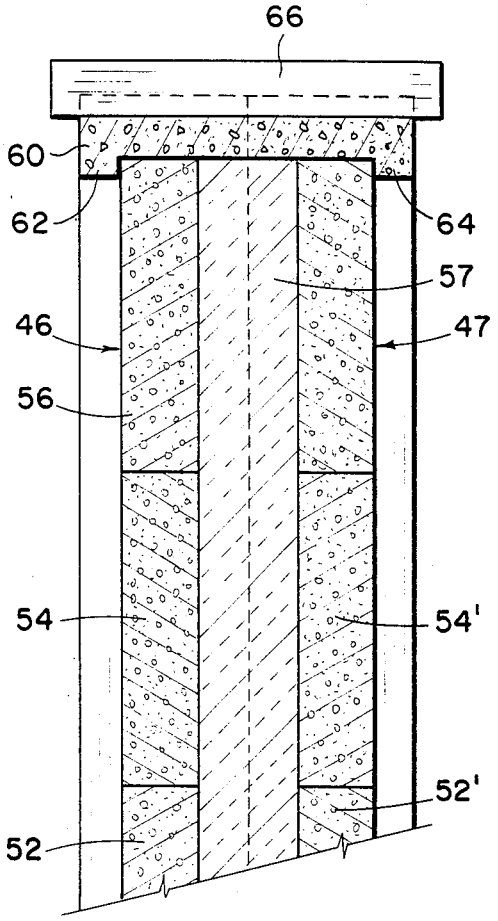
FIG. 3 is a sectional view taken along the line 3—3 of FIG. 1.

As shown in FIGS. 2 and 3, another set of panels 47 are provided in slots 30 and 34 respectively of posts 10 and 12. The joint between the various panel sections 54 and 56 is shown as being a butt joint, however, any other type joint such as tongue and groove or overlapping lip and so forth, can be used.

The space between the panels 46 and 47 is filled with an insulating material. It is preferred that the material be a liquid insulating material which sets up after it has been placed in the space. A suitable material is a Tri-Polymer Foam Insulation available from C.P. Chemical Co., White Plains, N.Y. This type foam expands slightly as its sets up and will exert an outward force on the panels thus causing them to be securely anchored in their respective slots in the posts. The foam also, as it sets up, will bond to the cement.

Figure 5:
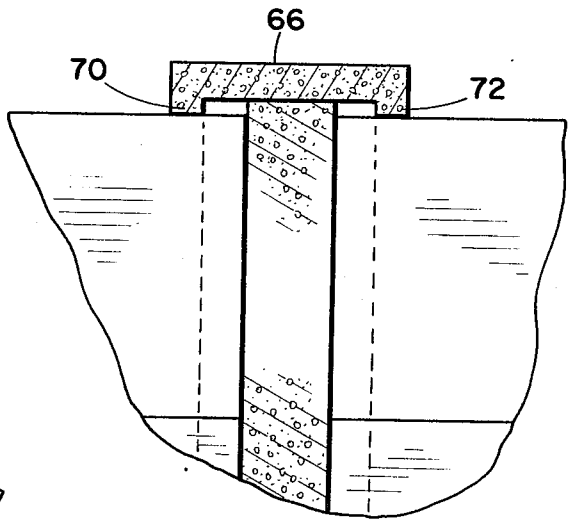
FIG. 5 is a view taken along the line 5—5 of FIG. 1.
Figure 6:
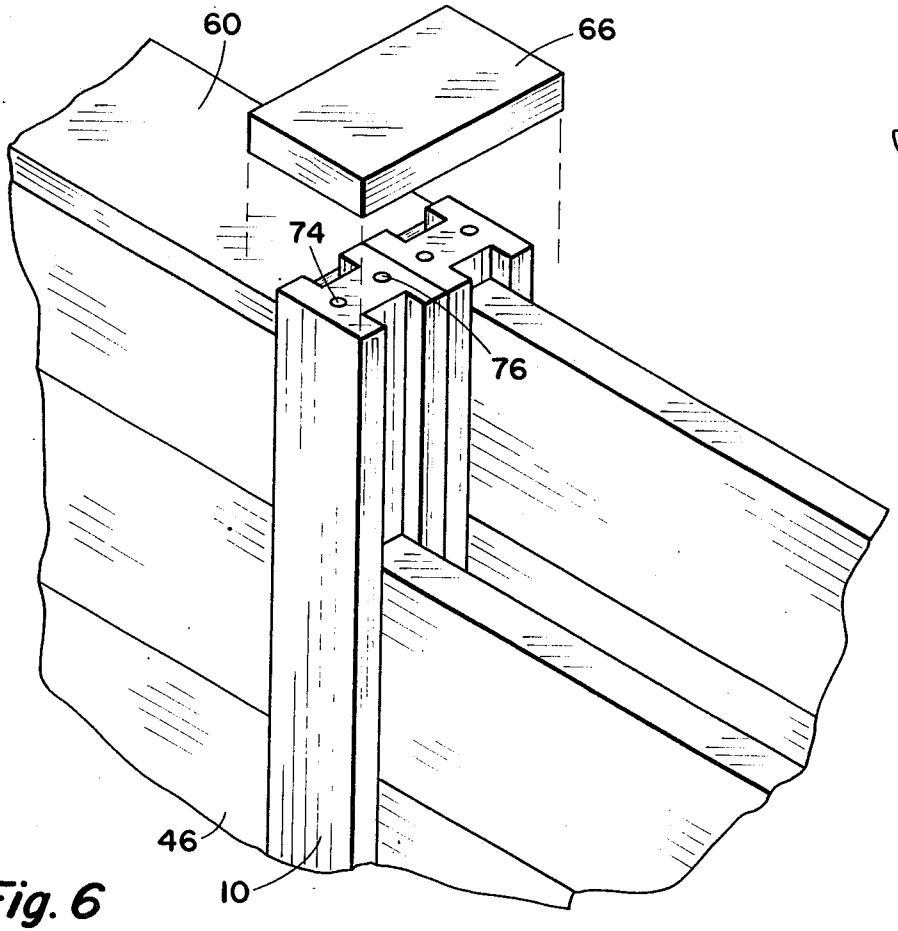
FIG. 6 shows the support posts and post cap.

As shown in FIG. 3, a rail cap 60 with lips 62 and 64 is provided over the top of the two rail panels 46 and 47 and also covers the insulation 57. As shown in FIGS. 3 and 6, a post cap 66 is provided on top of the posts 10, 12, etc., and as shown in FIG. 1, extends out over the rail cap 60. With this arrangement, essentially no water runs down inside the space between the two outer rails. As shown in FIG. 5, post cap 66 also has side lips 70 and 72. As can be seen in FIG. 6, the post 10 extends slightly above rail cap 60 on top of the panel 46. The concrete post 10 preferably includes a plurality of reinforcing rods 74 and 76 as indicated in the various figures.

Figure 4:
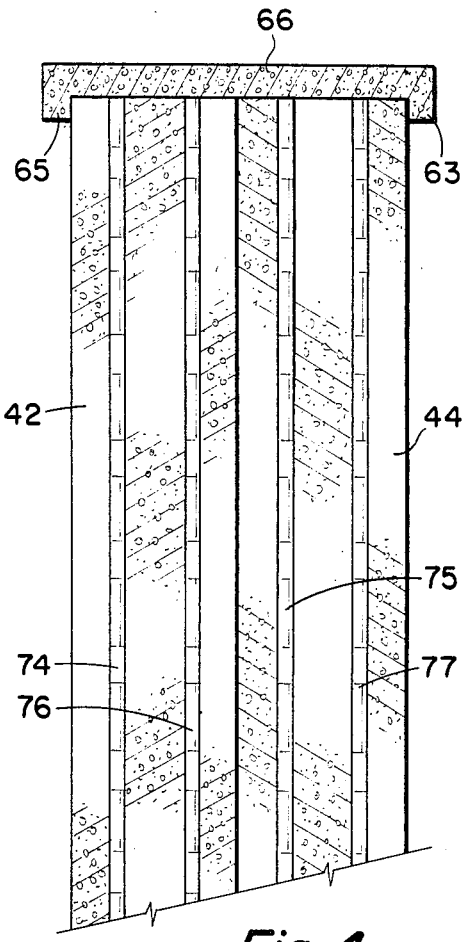
FIG. 4 is a sectional view taken along the line 4—4 of FIG. 1.
Figure 7:
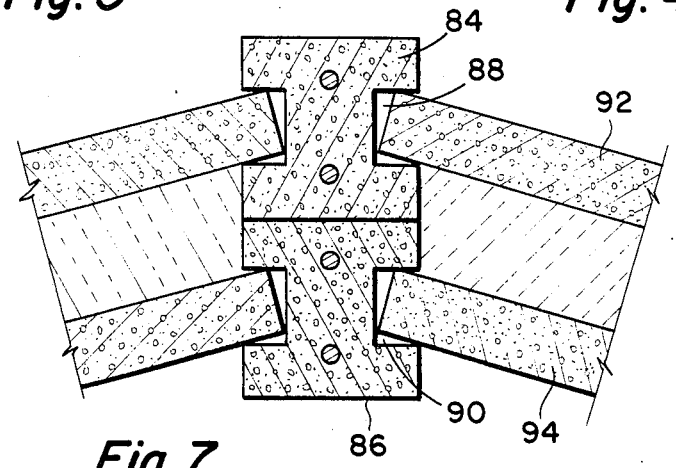
FIG. 7 shows a view of the sound barrier fence making an angle.

With this arrangement, it is also possible and conveniently easy to change the direction of the fence. For example in FIG. 2, if it is desired to cause the fence to go at a right angle to the previous fence as indicated by panels 48 and 46, all that is necessarry to do is to set another post 16 adjacent to post 18 and provide post 18 with an additional groove 78 and post 16 with a groove 80 so that the fence extension 82 can be placed in such grooves similarly as described above in regard to panels 46 and 48. FIG. 7 shows another way of making the fence take a different angle, something between a straight line and a right angle. There the posts 84 and 86 are merely provided with larger than normal grooves 88 and 90 and the panels 92 and 94 are placed at the desired angle. The left side of FIG. 7, of course, can be the same as the right side thereof. As shown in FIG. 4, cap 66 has lip 63 which complements lips 72 and 72 of FIG. 5 such that cap 66 has a downwardly protruding lip around its entire periphery.

Typically, the posts 10, 12, etc., would be about five feet apart and are about five inches square, with three-eighth inch reinforcement bars in the posts. The individual panel sections 50 and 52 are typically one foot in height and about two inches in thickness with #9 wire mesh for reinforcement in each panel. The space between the panels in which the insulation material is pumped is typically about four inches. These dimensions just given are by way of example, for a typical sound barrier fence, but are not to be in any way limiting inasmuch as various modifications can be made in the size without departing from the invention.

While no direct measurements have been made on the effectiveness of this sound barrier fence, it is believed from calculations that a six foot fence errected in accordance with this invention will reduce the noise level in a backyard, for example, which is adjacent a freeway by as much as 75%.

I prefer to make the face of the wall panels which will be seen to resemble wood grain or to appear Roman stone. This is far more eye pleasing than just plan concrete.

While this invention has been described with a certain degree of particularly, it is manifest that many changes may be made in the details of construction and the arrangement of components without departing from the spirit and scope of this disclosure. It is understood that the invention is not limited to the embodiments set forth herein for the purposes of exemplification, but is limited only by the scope of the attached claim or claims, including the full range of equivalency to which each element thereof is entitled.

What is claimed:

1. A sound barrier fence having:

a first post having a first and a second notch spaced from each other and each notch having an outer side;

a second post having a third and fourth notch with each said notch having an outer side;

a high density first vertical panel having one end placed in said first notch and a second end placed in said third notch;

a high density second vertical panel having a first end in placed in said third notch and a second end placed in said fourth notch;

a low density material held in compression between said first vertical panel and said second vertical panel and forcing said first vertical panel against the outer side of said first and third notch and holding the second vertical panel against the outer surfaces of said second and fourth notch to securely anchor said panels in their respective notches.

2. A sound barrier fence as defined in claim 1 in which said low density material is a tripolymer foam insulation.

3. A sound barrier fence as defined in claim 1 in which said upright panels are made of concrete prepared from portland cement.

4. A sound barrier fence as defined in claim 3 including a rail cap across a top of said two upright panels of said insulation material and a post cap across the top of said post.

* * * * *